United States Patent [19]

Wang

[11] Patent Number: 5,050,309

[45] Date of Patent: Sep. 24, 1991

[54] ROLLING RULER HAVING A RETRACTABLE AND ROTATABLE PIVOT PIN

[76] Inventor: Wei Wang, 3757 16th Ave. South, Minneapolis, Minn. 55407

[21] Appl. No.: 588,099

[22] Filed: Sep. 24, 1990

Related U.S. Application Data

[63] Continuation of Ser. No. 452,010, Dec. 18, 1989, abandoned.

[51] Int. Cl.[5] ..... B43L 13/02

[52] U.S. Cl. ..... 33/449; 33/27.03

[58] Field of Search ..... 33/448, 449, 450, 27.03, 33/27.04, 566, 27.05, 27.06

[56] References Cited

U.S. PATENT DOCUMENTS

| | | | |
|---|---|---|---|
| 704,313 | 7/1902 | Gerardin | 33/448 |
| 1,447,207 | 3/1923 | Golden | 33/27.03 |
| 1,825,266 | 9/1931 | Fischer | 33/27.03 |
| 2,438,337 | 3/1948 | Gordon | 33/27.03 |
| 2,542,537 | 2/1951 | Klemm | 33/27.03 |
| 2,612,690 | 10/1952 | Cotton | 33/27.03 |
| 2,789,335 | 4/1957 | Priess | 33/449 |
| 3,128,555 | 4/1964 | Jackson | 33/27.03 |
| 3,165,839 | 1/1965 | Hoagland | 33/449 |
| 3,195,235 | 7/1965 | Regan | 33/449 |
| 3,263,334 | 8/1966 | Mutter | 33/27.03 |
| 3,491,448 | 1/1970 | Quinton et al. | 33/27.03 |
| 3,726,017 | 4/1973 | De Mathe | 33/449 |
| 3,775,853 | 12/1973 | Doret et al. | 33/27.03 |
| 4,087,917 | 5/1978 | Sheerer | 33/448 |
| 4,267,638 | 5/1981 | Heinz | 33/27.03 |
| 4,314,408 | 2/1982 | Shoemaker | 33/488 |

FOREIGN PATENT DOCUMENTS

| | | | |
|---|---|---|---|
| 345407 | 9/1936 | Italy | 33/449 |
| 0217974 | 4/1987 | Italy | 33/27.03 |
| 313585 | 8/1956 | Switzerland | 33/449 |
| 120143 | 3/1958 | U.S.S.R. | 33/449 |
| 2118105 | 10/1983 | United Kingdom | 33/449 |
| 2213947 | 8/1989 | United Kingdom | 33/42 |

OTHER PUBLICATIONS

Popular Mechanics, Aug. 1949, p. 104.

*Primary Examiner*—William A. Cuchlinski, Jr.
*Assistant Examiner*—Alvin Wirthlin
*Attorney, Agent, or Firm*—Jacobson & Johnson

[57] ABSTRACT

A multipurpose ruler to permit a user to precisely draw geometric shapes as well as to store information including a housing having a rotatable roller with multiple information areas and an alignment mark to permit the user precisely align the ruler for accurately drawing geometric figures. A retractable pivot pin permits the user to draw circles about the pivot pin and a transparent housing permits a user to readily view information stored on the ruler.

2 Claims, 3 Drawing Sheets

ROLLING RULER HAVING A RETRACTABLE AND ROTATABLE PIVOT PIN

This application is a continuation of application Ser. No. 07/452,010, filed 12/18/89, now abandoned.

FIELD OF THE INVENTION

This invention relates generally to multipurpose rulers and, more specifically, to a pocket type ruler that permits the user to draw precise circles, rectangles, squares, parallel lines, angled lines, and to store information for ready use.

BACKGROUND OF THE INVENTION

The concept of instruments that perform one or more functions is known in the art. The present invention provides an improvement over existing inventions by permitting the user to quickly and accurately make geometric figures with a single instrument.

DESCRIPTION OF THE PRIOR ART

The 1923 Golden U.S. Pat. No. 1,447,207 shows a a protractor and a ruler combination with a suction cup to permit the user to attach the instrument to a blackboard.

The 1948 Gordon U.S. Pat. No. 2,438,337 shows a combination ruler and compass with a point that can be pressed into the paper to permit the user to draw a circle.

The 1952 Cotton U.S. Pat. No. 2,612,690 shows a combination compass and straight edge that can also be used as a T square.

The 1964 Jackson U.S. Pat. No. 3,128,555 shows a circle making attachment for a ruler.

The 1965 Hoagland U.S. Pat. No. 3,165,839 shows a drafting device that includes a pair of rollers to permit the user to roll the drafting instrument along a paper.

The 1965 Regan U.S. Pat. No. 3,195,235 shows a ruling instrument with a roller and slotted ends to permit the roller to slide up in the slots as one presses down on the ruler.

The 1966 Mutter U.S. Pat. No. 3,263,334 shows a beam compass having an extendible arm and a vernier adjustment.

The 1973 Mathe U.S. Pat. No. 3,726,017 shows a dial drafting device that has bolt actuated pivot pin and a brake mechanism.

The 1973 Doret et al. U.S. Pat. No. 3,775,853 shows a portable drafting instrument for drawing lines and circles on either paper or blackboards.

The 1982 Shoemaker U.S. Pat. No. 4,314,408 shows a combination drafting instrument including a beam compass, a magnifying glass, a protractor, a proportional divider and an architecture and engineering scale to permit the user to perform conventional drafting functions.

SUMMARY OF THE INVENTION

Briefly, the present invention comprises an instrument that permits the user to draw circles, rectangles, parallel lines, angled lines as well as to precisely space the lines. Besides being capable of drawing geometric shapes the invention includes a rotatable information tube, a reference line for precise movement of the ruler, a finger pivot pin to permit rotation of the housing about the pivot pin, a thumbwheel for setting the rotational information tube at a particular location, a magnifier with a sight line, and a transparent housing that permits viewing of information located on the rotational informational tube and also forms a handle to permit the user to quickly position my invention in a position for drawing geometric shapes.

DESCRIPTION OF THE PREFERRED EMBODIMENT

Figure 1:
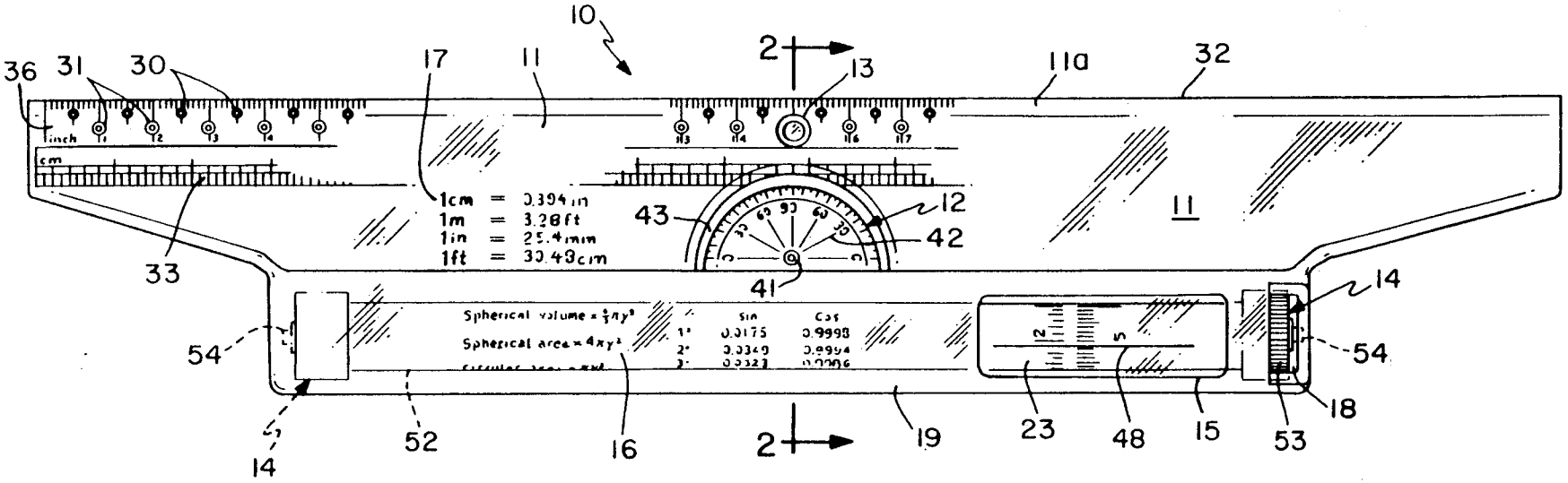
FIG. 1 shows a top view of my invention.
Figure 2:
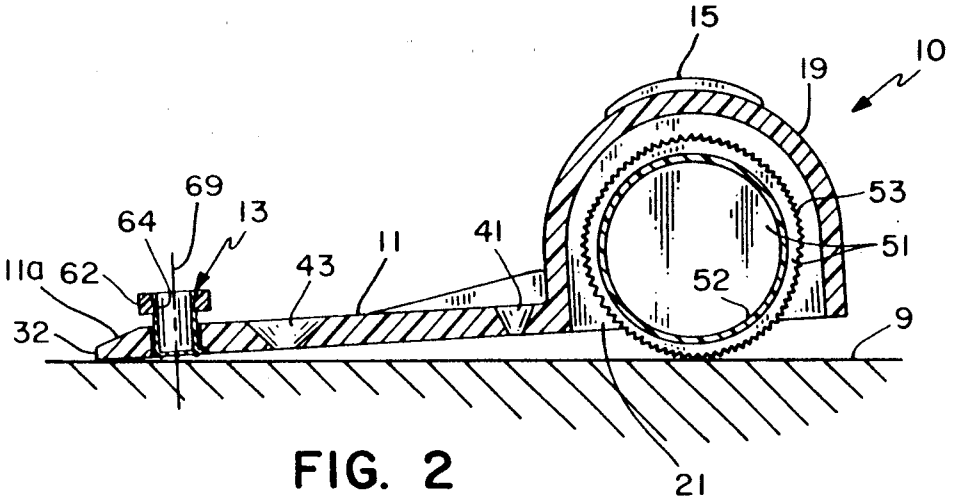
FIG. 2 shows a sectional view taken along lines 2—2 of FIG. 1.

Referring to FIG. 1 and FIG. 2 reference numeral 10 generally identifies my improved multiple task ruler or drafting instrument that comprises a trapezoidal shaped flat member 11 extending lengthwise along a transparent hollow housing 19 that rotationally supports an elongated roller 14.

Figure 5:
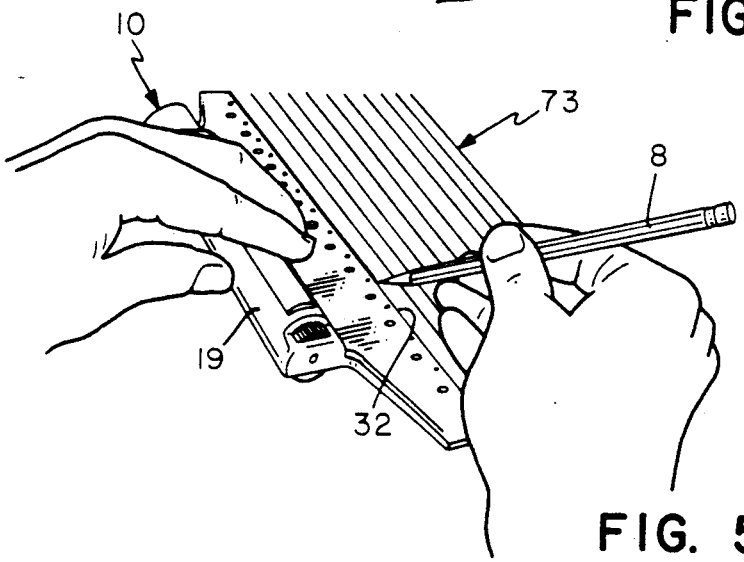
FIG. 5 shows the use of my invention to draw spaced parallel lines.
Figure 6:
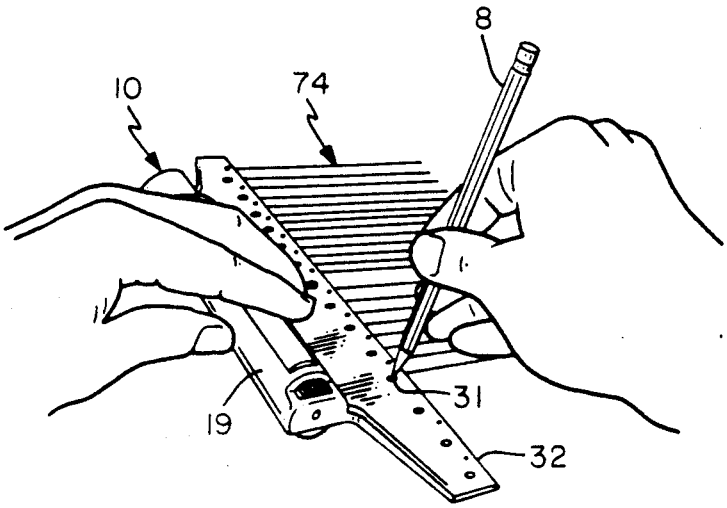
FIG. 6 shows the use of my invention to draw spaced parallel lines perpendicular to the straight edge of my invention.

Transparent housing 19 has a general elongated semi-cylindrical shape to permit a user to grasp and manipulate my multiple purpose drafting instrument with the fingers and thumb of one hand. FIG. 5 and FIG. 6 illustrate the feature of how the user can grasp and manipulate my invention by grasping the housing with one hand.

Located within transparent semi-cylindrical housing 19 is a semi-cylindrical cavity 21 holding elongated roller 14 therein. A cylindrical pin 54 extends from one end of roller 14 and an identical cylindrical pin 54 extends from the opposite end of roller 14 to form means to rotatable support roller 14 about a central axis of rotation extending through cylindrical pins 54.

Located on one end of roller 14 is a first roller wheel 51 having a frictional surface 53 thereon and similarly located on the opposite end of roller 14 is an identical second roller wheel (not shown) also having an identical frictional surface thereon. A cylindrical information tube 52 extends between the roller wheels. Information tube 52 has a first circumferential information area 16 and a second circumferential information area 23 that extend circumferentialy around the outer cylindrical surface of information tube 52. Information area 23 includes a scale such as centimeters or inches that extends circumferentialy around tube 52 to provide a visual indication of the rotational displacement of tube 52. That is, the scale on information area 23 can permit a user to rotate tube 52 a precise amount since the amount of rotational displacement can be observed by the user by viewing the scale beneath sight line 48.

FIG. 2 shows that the frictional surface 53 on the roller wheel 51 projects outward from housing 19 to permit a user to roll my multiple purpose drafting instrument along a sheet of paper by pulling or housing 19. The roller wheel on the opposite end functions in an identical manner and will not be described herein. The roller wheels are of the same diameter so that when the user pulls perpendicularly on housing 19 the rollers displace the housing in a direction perpendicular to housing 19.

Located on one end of housing 19 is a roller wheel or thumbwheel opening 18 that permits a user to rotate rotatable information tube 52 until the appropriate information in information area 16 is visible through the transparent housing 19. Typically, such information as simple area or volume formulas could be located thereon. My invention also permits a user to add his or her own information area 16 since a portion of information area 16 is accessible from the underside of housing 19.

Figure 9:
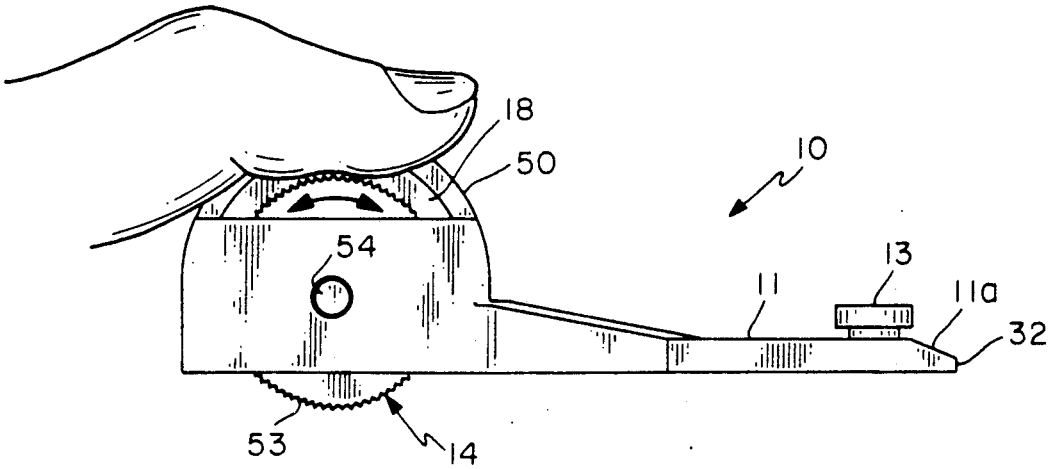
FIG. 9 shows the use of my invention as an information device.

FIG. 9 illustrates how the user can rotate roller 14 through a tangential thumb action on frictional surface 53. The thumbwheel opening 18 also permits a user to rotate tube 52 until the appropriate marking in information area 23 is in alignment with a sight line 48. This feature allows the user to zero the wheel during use as a drafting instrument. Consequently, a person using my invention can adjust the instrument without having to roll the instrument along a surface.

FIG. 1 and FIG. 2 show the front portion of my invention includes a flat member 11 extending outward from housing 19. Located along the beveled edge 11*a* of flat member 11 is a first measuring scale 36 (designate in inches) The flat member 11 also includes a straight edge 32 located thereon to permit a user to draw straight lines by guiding the tip of a pencil along straight edge 32. The flat member 11 also includes a first set of equally spaced conical openings 30 for insertion of a point of a pencil therein to permit the user to draw lines perpendicular to edge 32. The openings 30 are located in a straight line and align with markings on scale 36 to permit a user to accurately draw lines using the openings as a pencil point guide.

Flat member 11 also includes a second plurality of spaced conical openings 31 for insertion of a point of a pencil therein to permit a user draw circles or straight lines. The openings 31 are in alignment with markings on the scale 36 to permit the user to precisely locate a pencil point with respect to a reference scale. The second plurality of openings 31 are also located in a line that is parallel to the axis of rotation of roller 14 so that a user can use the second set of openings to draw lines perpendicular to the axis of rotation of roller 14 by placing a pencil point in one of the openings and rolling the roller wheels along a work surface. In addition the second set of openings permit a user to quickly and efficiently draw circles with my invention.

Figure 4:
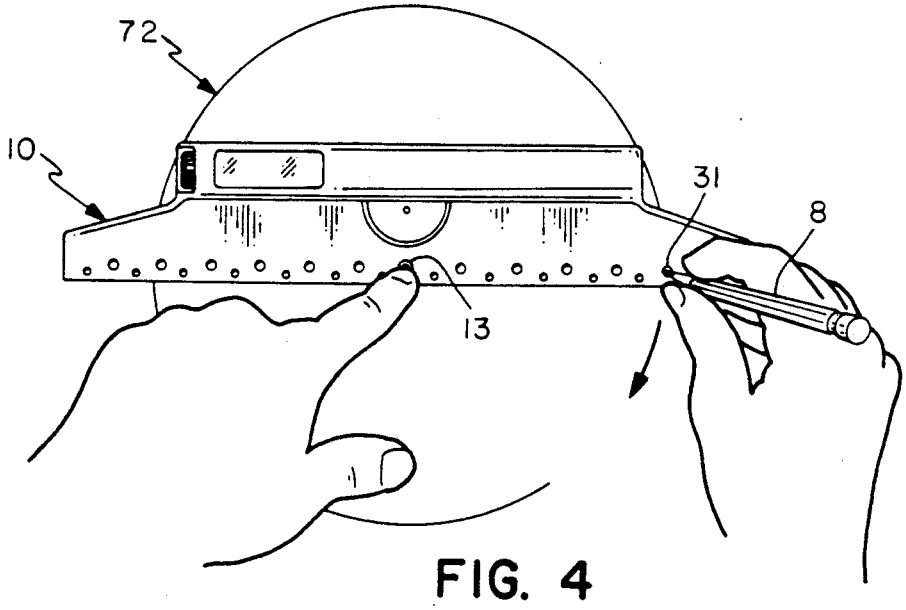
FIG. 4 shows the use of my invention to draw circles.

FIG. 4 illustrates how a user can draw circles using openings 31.

FIG. 5 illustrates how a user can precisely draw lines 74 parallel to edge 32 and the axis of rotation of roller 14.

FIG. 6 illustrates how a user can precisely draw lines perpendicular to edge 32 and the axis of rotation of roller 14.

Figure 3:
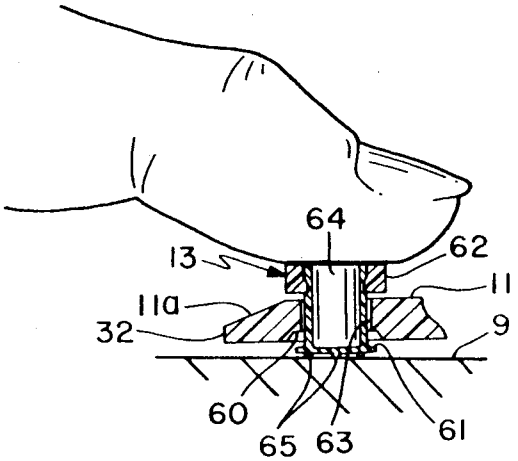
FIG. 3 shows a partial sectional view of my retractable pivot pin.

In order to more fully understand the use of my invention as a compass to draw circles reference should be made to FIG. 2 and FIG. 3 which shows a cylindrical retractable pivot pin 13 mounted in flat member 11. Retractable pivot pin 13 has a top finger pressure area on one end and an end surface 61 with a plurality of surface engaging means 65 located on the opposite end. Typically, the surface engaging means can be conical points or some other material or surface that will engage the work surface such as a sheet of paper without slippage. Retractable pivot pin 13 is rotatably mounted in flat member 11 to permit rotation of flat member 11 and housing 19 about a substantially vertical axis 69 extending through rotatable pivot pin 13. Located around the top of retractable pin 13 is a first collar 62 and located at the bottom is a second collar 61. A cylindrical tube 64 connects collar 61 to 62 to form a spool like pivot pin 13.

Collar 61 and 62 are slightly larger then the cylindrical opening 63 to prevent pin 13 from being withdrawn from opening 63. Opening 63 is sufficiently large so pivot pin 13 can freely rotate therein as well as slide upward and downward in response to finger pressure on pin 13. FIG. 2 illustrates pin 13 in the retracted position and FIG. 3 shows pin 13 in the extended position with collar 61 spaced from annular recess 60 in the bottom side of flat member 11. With pivot pin 13 held against the work surface a user can draw a circle by placing a pencil point in one of openings 31 and then rotating my multiple purpose drafting instrument 10 about pivot pin 13 with a pencil point. FIG. 4 shows how a user can draw a circle 72 by use of pivot pin 13 and opening 31. If the user wishes to make a smaller or larger diameter circle the user can select different openings located along scale 31.

Figure 7:
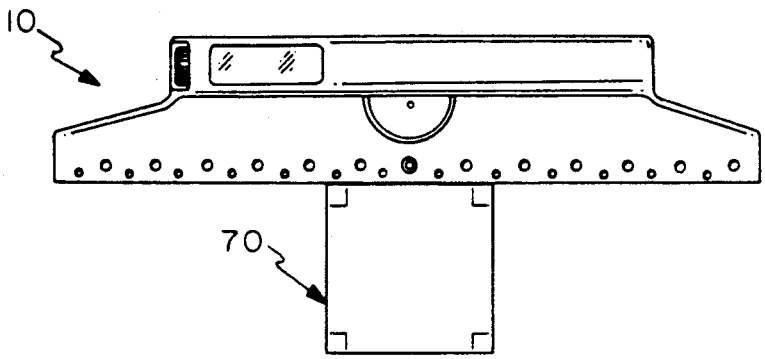
FIG. 7 shows the use of my invention to draw rectangles.

Another feature of my invention is a magnifier 15 located on housing 19. Magnifier 15 contains a sight or reference line 48 that permits the user to have a constant reference point. Magnifier 15 is positioned proximate second information area 23 to permit a user to view the information in the second information area 23 through magnifier 15. Information area 23 includes a measuring scale that is laid out around the peripheral region of tube 52. The purpose of measuring scale and the reference line 48 is to permit the user to accurately space how far one moves my instrument when drawing parallel lines with edge 32. That is, a user can accurately space parallel lines 73 as illustrated in FIG. 5 by using the measuring scale graduation lines that are in alignment with reference line 48. A further feature of the invention is that the user can draw squares rectangles or the like by using the precise rolling feature of my invention. FIG. 7 illustrates how a square 70 can be drawn with my invention through drawing parallel and perpendicular lines.

My invention also includes a protractor 12 having angle marking openings located in flat member 11. Protractor 12 includes a central opening 41 for placing on a line or the intersection of two lines. Protractor 12 also includes an arcuate opening 43 a graduated angle scale 42 located adjacent thereto to permit a user to determine the angle of two lines. Arcuate opening 43 that extends for 180 degrees to permit a user to accurately mark the angle of lines with my invention.

Figure 8:
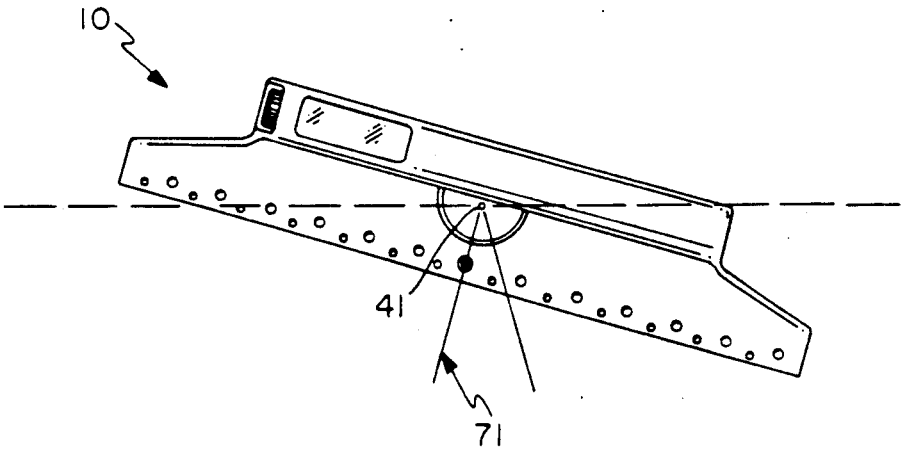
FIG. 8 shows the use of my invention to draw angled lines.

FIG. 8 illustrates how a user can use my protractor to measure the angle between lines 71 by use of opening 41 at the point of intersection.

It is apparent that my multiple purpose drafting instrument can be made solely out of lightweight polymer plastic to provide a lightweight ruler for use in multiple applications.

I claim:

1. A multiple purpose drafting instrument that a person can hold and manipulate with one hand to permit the user to draw various geometric shapes comprising:

a transparent housing, said transparent housing having a general elongated semi-cylindrical shape to permit a user to grasp and manipulate the multiple purpose drafting instrument with the fingers and thumb of one hand, said housing having a semi-cylindrical cavity therein for insertion of a roller, said housing having a top and a bottom, said housing including means for rotatably supporting a roller therein;

a rotatable roller located in said transparent housing, said rotatable roller having a first end and a second end, said rotatable roller having an axis of rotation extending through said rotatable roller, said rotatable roller having a rotatable information tube including a first information area for containing general information and a second information area including a graduated measuring scale, said rotatable information tube rotatably mounted in said cylindrical housing to permit a user to rotate said rotatable information tube to permit the user to view information located on said rotatable information tube through said transparent housing;

a first roller wheel having a frictional surface thereon located on one end of said rotatable roller and a second roller wheel having a frictional surface thereon located on the opposite end of said rotatable roller to permit a user to move said multiple purpose drafting instrument along a work surface, said roller wheel rotatingly supporting said transparent housing above the work surface;

a roller wheel opening located in said top of said semi-cylindrical housing, said roller wheel opening located in one end of said semi-cylindrical housing to permit a user to rotate said rotatable information tube through said roller wheel opening in said top side of said semi-cylindrical housing with the thumb of the user until the appropriate information is visible through said semi-cylindrical housing by tangentially pushing on the roller wheel projecting through said roller wheel opening;

a flat member extending outward from said housing, said flat member having a center region, said flat member including a straight edge located thereon to permit a user to draw straight lines by guiding the tip of a pencil along said straight edge, said flat member including a first set of spaced openings for insertion of a point of a pencil, said flat member having a pivot pin opening located in said center region of said flat member for receiving a pivot pin, said pivot pin opening in said flat member sufficiently large to permit a retractable and rotatable pivot pin to rotate freely therein, said flat member having an annular recess therein for receiving a collar of a retractable and rotatable pivot pin;

a retractable and rotatable pivot pin mounted in said center region of said flat member, said retractable and rotatable pivot pin having an end surface with a plurality of surface engaging means, said plurality of surface engaging means comprising a plurality of conical points spaced on said end surface over an extended area to thereby permit said surface engaging means located thereon to engage the work surface without slippage of said plurality of surface engaging means, said retractable and rotatable pivot pin having a central axis and located axially displaceable in said flat member, said retractable and rotatable pivot pin rotatably mounted in said flat member to permit rotation of said flat member about said retractable and rotatable pivot pin when said retractable and rotatable pivot pin is held stationary, said retractable and rotatable pivot pin having a first collar extending from said retractable and rotatable pivot pin, said retractable and rotatable pivot pin having a second collar extending from said retractable and rotatable pivot pin, said first collar and said second collar forming a spool like retractable and rotatable pivot pin for rotational and axial displacement in said opening in said flat member, said second collar co-acting with said first collar to limit axial displacement of said retractable and rotatable pivot pin in said flat member, said annular recess forming a compartment for said second collar so said second collar can retract into said recess to prevent said second collar from interfering with the placement of said drafting instrument, said first set of spaced openings and said retractable and rotatable pivot pin located in a straight line, said retractable and rotatable pin operable to push into frictional engagement with the work surface located beneath said flat member to permit a user to draw a circle by placing a pencil point in one of said first plurality of openings and then rotating said multiple purpose drafting instrument about said retractable and rotatable pivot pin with the pencil point;

a first measuring scale located on said flat member, said first measuring scale including a second plurality of openings spaced thereon to permit a user to insert the tip of a pencil therein so the user can mark the paper through the second plurality of openings in said straight edge, said second plurality of openings located in a line that is parallel to the axis of rotation of said cylindrical roller so that a user can draw lines perpendicular to the axis of rotation of said cylindrical roller by placing a pencil point in one of said second plurality of openings and rolling said roller wheels along the work surface;

a magnifier located on said housing, said magnifier positioned proximate said second information area to permit a user to view the information in said second information area through said magnifier, said magnifier including a reference line to permit the user to precisely align said rotatable information tube with said reference line; and a protractor located in said flat member, said protractor including a central opening for a user to mark the work surface below the central opening, said protractor including a graduated angle scale to permit a user to draw angled lines.

2. A multiple purpose drafting instrument that a person can hold and manipulate with one hand to permit the user to draw various geometric shapes comprising:

a transparent housing, said transparent housing having a general elongated semi-cylindrical shape to permit a user to grasp and manipulate the multiple purpose drafting instrument with the fingers and thumb of one hand, said housing having a semi-cylindrical cavity therein for insertion of a roller, said housing including means for rotatably supporting a roller therein;

a rotatable roller located in said transparent housing, said rotatable roller having a first end and a second end, said rotatable roller having an axis of rotation extending through said rotatable roller;

a first roller wheel having a frictional surface thereon located on one end of said rotatable roller and a second roller wheel having a frictional surface thereon located on the opposite end of said rotatable roller to permit a user to move said multiple purpose drafting instrument along a work surface, said roller wheel rotatingly supporting said transparent housing above the work surface;

a flat member extending outward from said housing, said flat member having a center region, said flat member including a straight edge located thereon to permit a user to draw straight lines by guiding the tip of a pencil along said straight edge, said flat member including a first set of spaced openings for insertion of a point of a pencil, said first set of spaced openings located in a line that is parallel to the axis of rotation of said cylindrical roller so that a user can draw lines perpendicular to the axis of rotation of said cylindrical roller by placing a pencil point in one of said plurality of openings and rolling said roller wheels along the work surface; said flat member having a pivot pin opening located in said center region of said flat member for receiving a pivot pin, said pivot pin opening in said flat member sufficiently large to permit a retractable and rotatable pivot pin to rotate freely therein, said flat member having an annular recess therein for receiving a collar of a retractable and rotatable pivot pin;

a retractable and rotatable pivot pin mounted in said pivot pin opening in said center region of said flat member said retractable and rotatable pivot pin having an end surface with a plurality of surface engaging means said, plurality of surface engaging means comprising a plurality of conical points spaced on said end surface over an extended area to thereby permit said surface engaging means located thereon to engage the work surface over said extended area without slippage of said plurality of surface engaging means, said retractable and rotatable pivot pin having a central axis and located axially displaceable in said flat member, said retractable and rotatable pivot pin rotatably mounted in said flat member to permit rotation of said flat member about said retractable and rotatable pivot pin when said retractable and rotatable pivot pin is held stationary, said retractable and rotatable pivot pin having a first collar extending from said retractable and rotatable pivot pin, said retractable and rotatable pivot pin having a second collar extending from said retractable and rotatable pivot pin, said first collar and said second collar forming a spool like retractable and rotatable pivot pin for rotational and axial displacement in said opening in said flat member, said second collar co-acting with said first collar to limit axial displacement of said retractable and rotatable pivot pin in said flat member, said annular recess forming a compartment for said second collar so said second collar can retract into said recess to prevent said second collar from interfering with the placement of said drafting instrument, said first set of spaced openings and said retractable and rotatable pivot pin operable to push into frictional engagement with the work surface located beneath said flat member to permit a user to draw a circle by placing a pencil point in one of said plurality of openings and then rotating said multiple purpose drafting instrument about said retractable and rotatable pivot pin with the pencil point; and a first measuring scale located on said flat member to permit a user to perform a number of different tasks with one instrument.

* * * * *